United States Patent [19]

Cambreleng

[11] Patent Number: 4,926,148

[45] Date of Patent: May 15, 1990

[54] AUXILIARY SWITCH RETAINER FOR CIRCUIT BREAKERS AND ACTUATOR MEMBER

[75] Inventor: Paul S. Cambreleng, Lambertville, N.J.

[73] Assignee: Heinemann Electric Company, Lawrenceville, N.J.

[21] Appl. No.: 252,814

[22] Filed: Oct. 3, 1988

[51] Int. Cl.[5] ..... H01H 73/12

[52] U.S. Cl. ..... 335/13; 200/303

[58] Field of Search ..... 335/13; 200/303

[56] References Cited

U.S. PATENT DOCUMENTS 3,720,891 3/1973 Nicol ..... 335/13

4,760,226 7/1988 Fasano ..... 335/13

*Primary Examiner*—H. Broome

*Attorney, Agent, or Firm*—Dann, Dorfman, Herrell and Skillman

[57] ABSTRACT

A circuit breaker having the generally rectangular case with an actuating switch handle on one edge and terminals at the opposite edge is provided with an auxiliary switch receptacle at the edge by the terminal. Retainer means is provided for holding the auxiliary switch in the receptacle and an access opening is provided through the edge wall for communication between the switch actuating member and a portion of the breaker mechanism moving in response to breaker contact opening and closing. A U-shaped retainer is preferably used to retain the switch in the receptacle by passing prongs thereof through the holes in the switch walls and the aligned switch holes. The actuator member may be in accordance with various types of mechanisms, either a compressible member or a rigid slide, and in either case is moved by the breaker mechanism into the actuating means of the switch. In the case of a rigid slide, the slide may be extended outside the switch retainer housing and provide coverage or exposure of a colored patch, indicating respectively open and closed breaker contacts.

19 Claims, 7 Drawing Sheets

AUXILIARY SWITCH RETAINER FOR CIRCUIT BREAKERS AND ACTUATOR MEMBER

The present invention relates to a conventional circuit breaker to which is added an auxiliary switch holder wherein an auxiliary switch may be inserted or replaced in the field. The invention also relates to retainer means for releasably holding the auxiliary switch in the holder and various actuator elements positioned within the casing between the breaker mechanism and the auxiliary switch actuating means.

In the prior art, auxiliary switches have sometimes been used in connection with circuit breakers to be simultaneously actuated on or off as the breaker contacts are closed and released to the other condition as the breaker contacts are opened. Auxiliary switches have not been convenient to employ in the prior art. The present invention provides means integral with the breaker and permitting actuation through the breaker mechanism whereby such an auxiliary switch can be easily added in the field and conveniently removed or replaced at will.

In accordance with the present invention, a switch receptacle is molded as part of the circuit breaker casing. Preferably the receptacle is molded to receive snugly a specific form of commercially available auxiliary switch element at the end of the breaker opposite its switch handle so as to be accessible behind the panel in which the circuit breaker is mounted and where electrical connections are made. The receptacle is preferably a molded extension of the casing, in most cases of two mating half shells, which half shells are a conventional means of constructing the breaker casing. The switch is preferably provided with at least one hole, and usually a pair of holes aligned with holes in the receptacle which allow a switch retainer to be put through the aligned holes to hold the switch in place, and advantageously the retainer will be U-shaped as will be described. A switch actuating means, usually a pushbutton, is normally spring loaded outwardly from an edge of the switch closest to the breaker mechanism and a suitable actuator member can be employed between a moving portion of the breaker mechanism and the actuating means. The actuator member preferably is normally urged away from the actuating position by the switch spring. It is urged into actuating position by contact with the breaker mechanism as the breaker contacts are closed against the action of the switch spring.

More specifically, the present invention concerns a housing for a circuit breaker structure containing a circuit breaker mechanism mechanically actuated by a handle at one edge of the housing and having electrical terminals for electrical connections at the opposite edge thereof. The housing is of generally rectangular from having broad enclosing faces and at least four narrow edge walls. Access to the breaker mechanism is provided through an opening in an edge wall opposed to that accommodating the actuator handle adjacent terminals for connecting the breaker to an electrical circuit. An auxiliary switch receptacle is connected to the housing along the edge wall providing access to the mechanism. The edge wall with the opening allows communication therethrough between the breaker mechanism and the actuating means of the switch. Means extending through aligned holes in the auxiliary switch and the receptacle is provided for retaining the switch in the receptacle. An actuator member extends through the opening between the switch actuating means and a portion of the breaker mechanism and moves in response to breaker contact opening and closing. The actuator member is retained in place laterally by a portion of the housing designed for that purpose.

The invention also concerns a preferred construction retainer means for holding the switch in the receptacle and various types of actuator members, as will appear hereafter.

For a better understanding of the present invention, reference is made to the accompanying drawings, in which.

Figure 1:
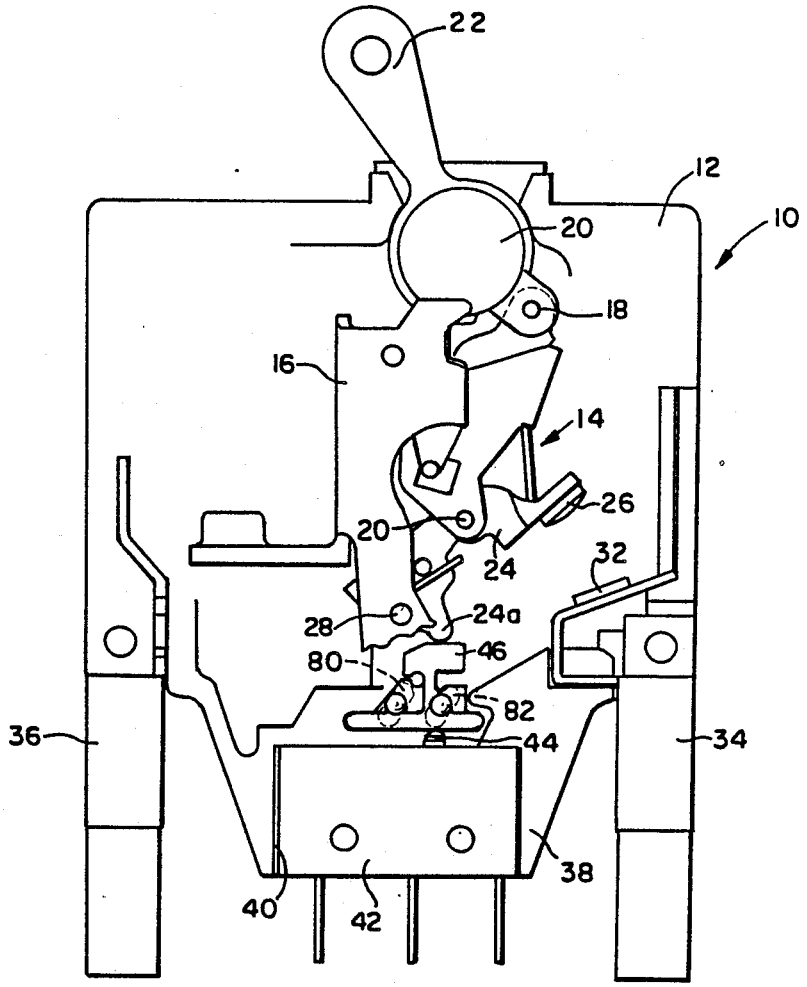
FIG. 1 is a somewhat schematic showing of the general layout of relevant parts of a circuit breaker with one side shell removed and employing an auxiliary switch receptacle in accordance with the present invention with an auxiliary switch in place and an actuator member in place to actuate the switch.
Figure 4A:
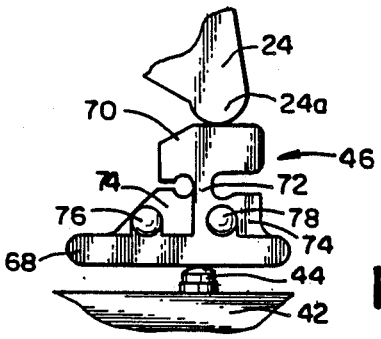
Figure 4B:
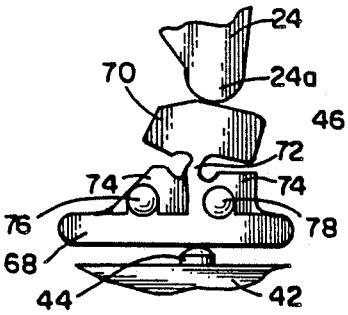
Figure 5:
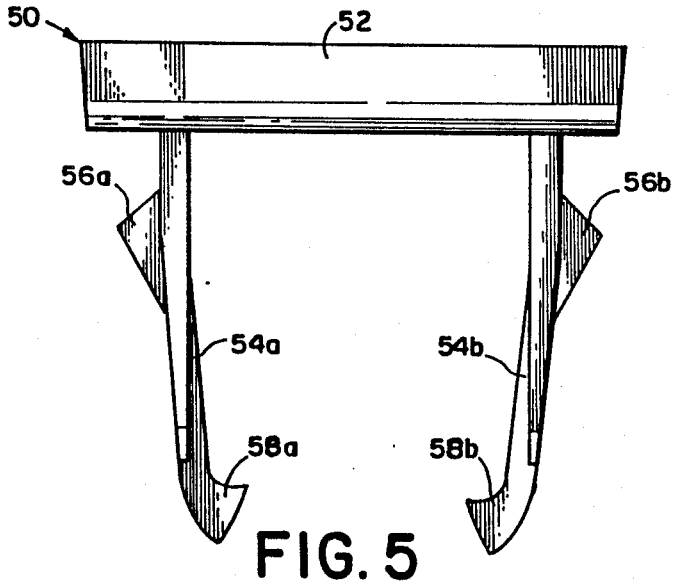
Figure 6:
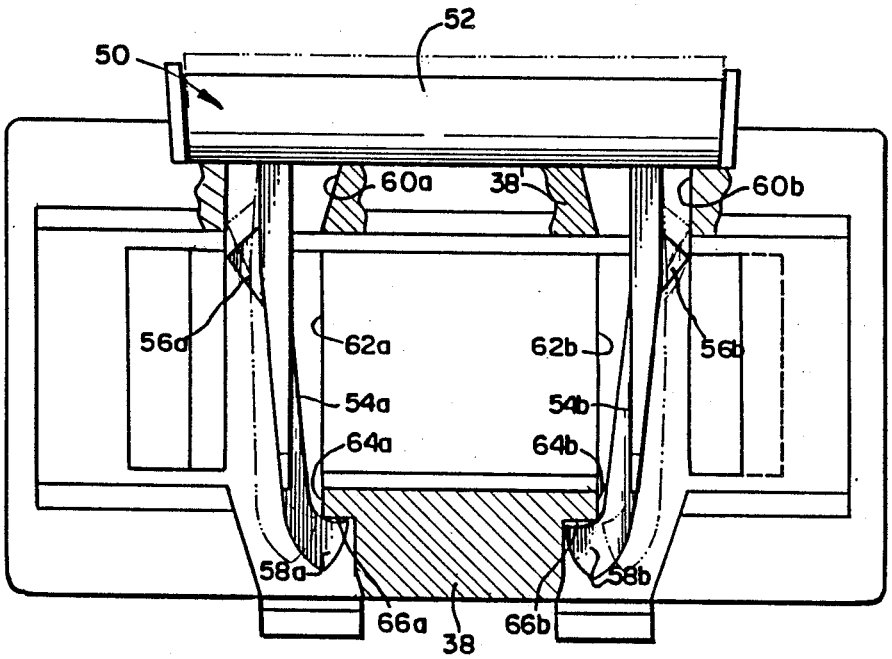
Figure 7:
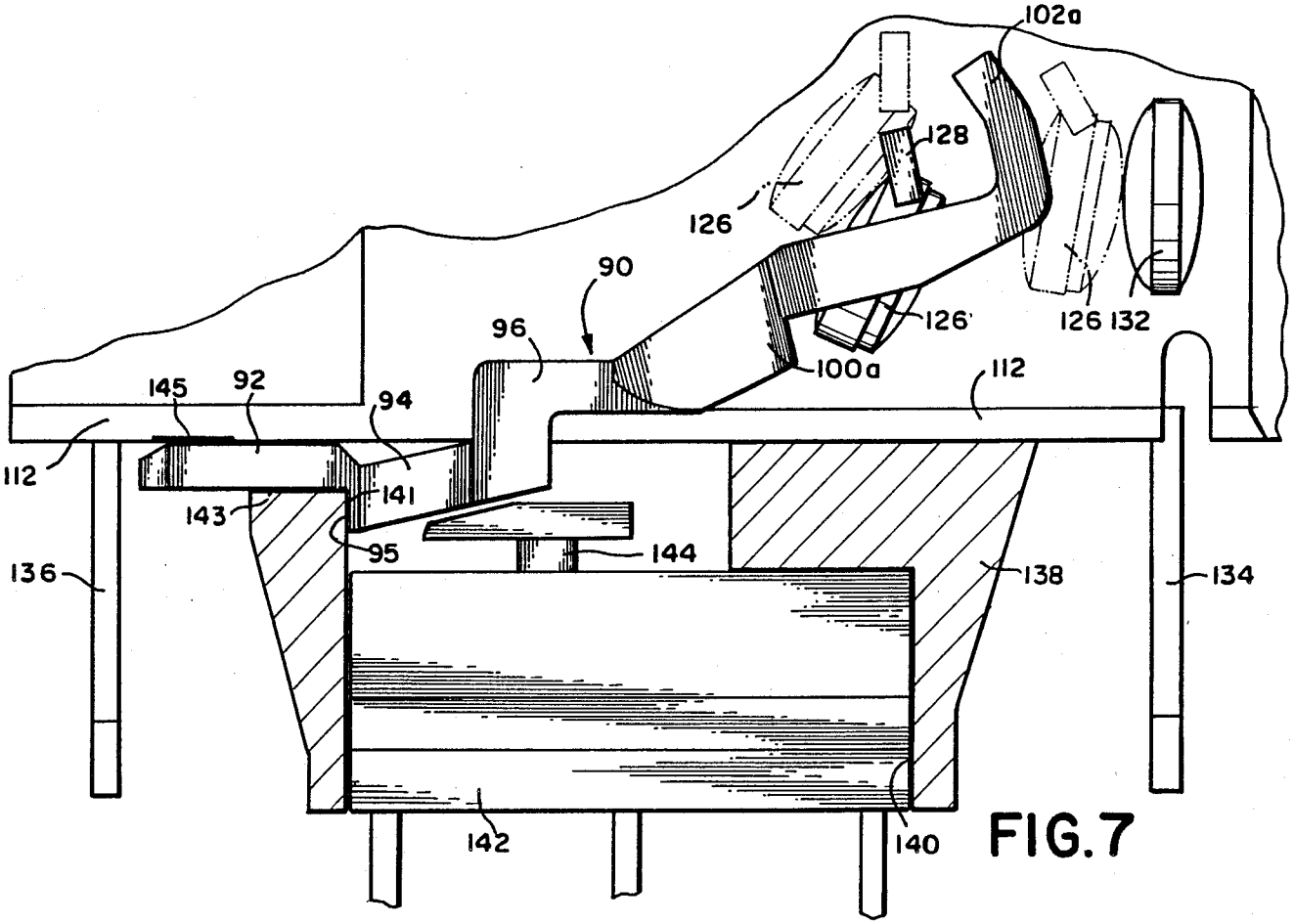
Figure 8:
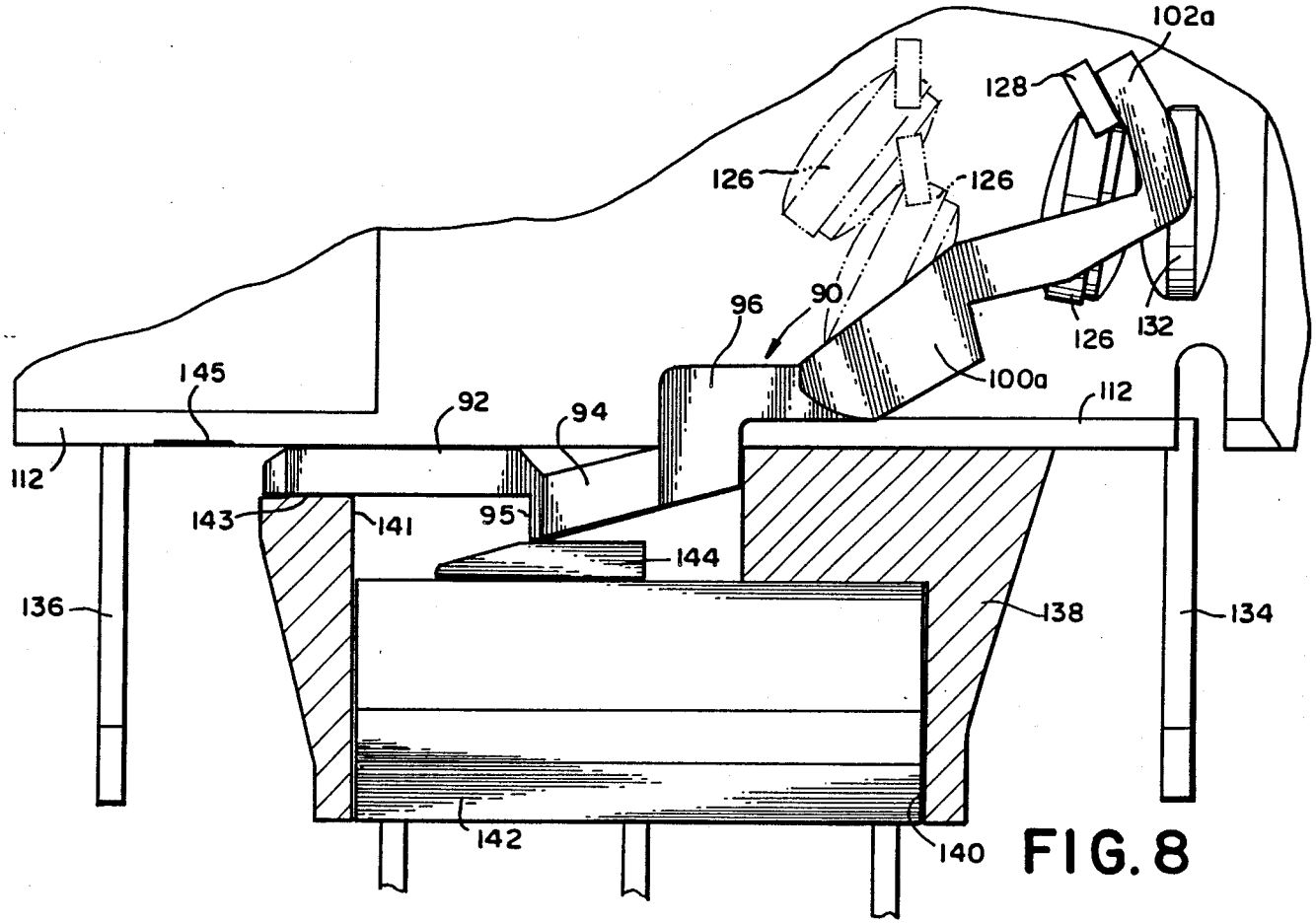
Figure 9:
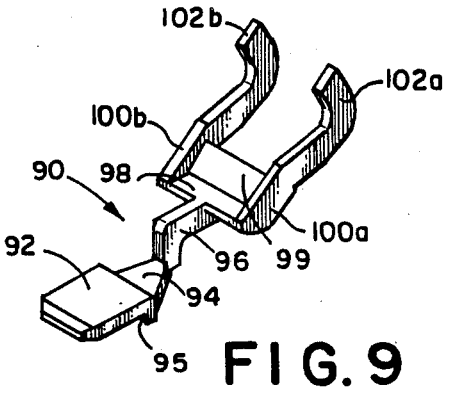
Figure 10A:
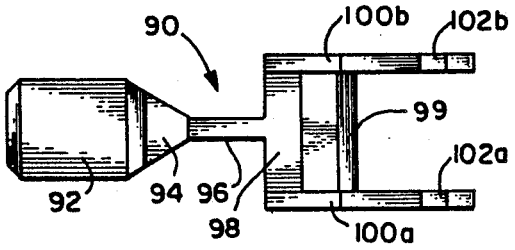
Figure 10B:
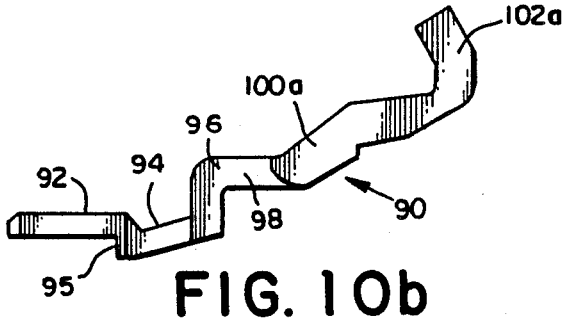

FIG. 4*a* is a plan view of the actuator member in its position between the breaker mechanism and the switch actuating means when the breaker contacts are opened;

FIG. 4*b* is a similar view showing the position of the actuator member between the same elements after the switch breaker contacts have been closed;

FIG. 5 is a side view of the switch retainer;

FIG. 6 is a view showing two stages of insertion of the switch retainer of FIG. 5 through holes in the sidewalls of the receptacle and holes in the auxiliary switch;

FIG. 7 is a partial view similar to FIG. 1 showing a different kind of breaker mechanism and a different actuator member in open breaker contact position;

FIG. 8 is a similar view showing the actuator member of FIG. 7 with the breaker in closed contact position;

FIG. 9 is a perspective view of a preferred slide actuator member for use in the embodiment of FIGS. 7 and 8;

FIG. 10*a* is a plan view from above of the actuator member of FIG. 9; and FIG. 10*b* is a side elevation view of the actuator member of FIG. 9.

Referring to FIG. 1, there is shown a partial view of some of the interior linkage structure of a circuit breaker, generally designated 10 with one half shell of the casing removed and only the right half shell 12 shown in outline. The type of circuit breaker and housing employed are similar to those shown in U.S. Pat. Nos. 3,955,162 and 4,267,539, for example. The breaker mechanism, generally designated 14, includes a frame 16 mounted on the housing and various linkages rotatably supported thereon. An actuatable member 18 is moved by actuator 20 attached to manual breaker switch handle 22 extending through an opening into the breaker casing 12, wherein it is rotatably supported relative to the housing. At the other end of the housing is the movable contact support 24 carrying the movable breaker contact 26 pivotally supported to rotate about pin 28 on the frame 16. Movable contact support 24 is joined to the actuator linkage mechanism by a pin 30 which allows the contact support 24 to be moved down so that the movable breaker contact 26 closes against the fixed breaker contact 32. Fixed contact 32 is supported on the housing shell 12 and connected to external terminal 34. Movable contact 26 through a conductive circuit (not shown) is connected to external terminal 36. These external terminals are the means by which the breaker is connected into the protected circuit. Ordinarily a breaker will be secured to a panel so that its manual breaker switch handle 22 is accessible but the rest of the breaker, including its electrical connections, is safely behind the panel.

Figure 2:
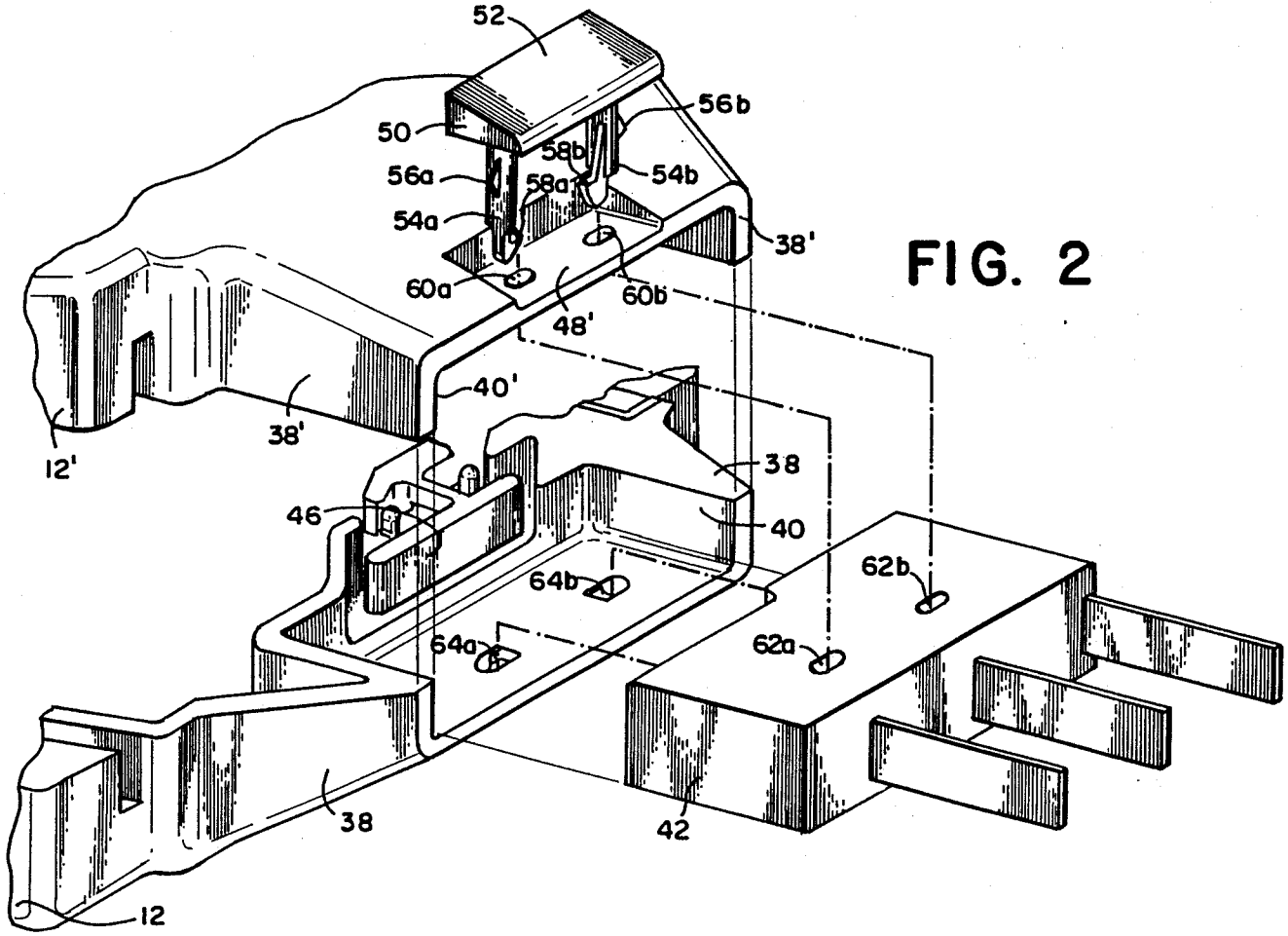
FIG. 2 is a perspective view showing the switch receptacle end of shells comprising the breaker housing in an exploded perspective view also showing the auxiliary switch and retainer.

In accordance with the present invention, the molded casing supports the switch receptacle 38. In a preferred embodiment as shown, the right shell 12 is molded integrally with one half of auxiliary receptacle 38 of the same resinous material. Similarly the other half of the receptacle 38' is molded integrally with the left shell 12'. As seen in FIG. 2, the two mate to form the completed receptacle when the breaker housing shells are assembled. As seen in FIG. 2, the extension 38 is provided with a recess 40, 40' preferably conforming to the shape and size of an auxiliary switch 42.

In passing, it should be noted that the switch receptacle need not be molded but may be attached to either or both shells in some other manner and the receptacle need not be conforming provided it is capable of holding the switch stationary with respect to the breaker. The switches themselves may vary and the receptacle is designed for a specific switch which may have any number of terminals, but is shown here as having three, protruding away from the receptacle in position for convenient circuit connection.

This particular switch is provided with a spring-loaded switch actuating means in the form of a plunger 44. The spring urges the plunger into the extended position shown in FIGS. 1 and 4*a*, representing one condition of the auxiliary switch. When depressed inwardly against the loading of its internal spring, the plunger produces the other condition of the switch 42. Between the plunger 44 and the breaker contact arm 24, and more specifically a protrusion 24*a* thereof, is an auxiliary switch actuator member 46. The auxiliary switch actuator member is designed to be moved into the switch actuating means, plunger 44, to change switch condition. In this embodiment the spring of the plunger will return the plunger and actuator member to its rest position of FIG. 4*a* when the movement of the breaker mechanism permits.

As seen in FIG. 2, in the left shell, and specifically in the switch receptacle extension 38' thereof, there is a recess 48' which is designed to receive auxiliary switch retainer 50, or more specifically the top 52 thereof. Top 52 may be made to conform to the casing 38 when fully inserted. Auxiliary switch retainer 50 has two resilient prong members 54*a* and 54*b*, respectively, preferably provided with cam members 56*a* and 56*b* and terminated in shoulder latch means 58*a* and 58*b* as lateral extensions at the ends of prongs 54*a* and 54*b*. Parallel holes 60*a* and 60*b* receive the prongs 54*a* and 54*b*, respectively. When the auxiliary switch is in position in the receptacle, a pair of aligned holes 62*a* and 62*b* permit passage of the prongs which then pass in turn through to holes 64*a* and 64*b* in the extension 38 of right shell 12. The cams 56*a* and 56*b* engage the sidewalls of the holes 62*a* and 62*b* and urge the bottom portion of the prongs toward one another so that as they pass out the bottom of holes 64*a* and 64*b*, the latch shoulders 54*a* and 54*b* will engage the outside of the right shell. In most cases rather than the actual shell surface, each hole 64*a* and 64*b* is enlarged to provide a latch opposing shoulder or ledge below the shell surface to permit engagement should the latch means 58*a* and 58*b* move into position. FIG. 5 shows another more detailed view of the auxiliary switch retainer. FIG. 6 is a somewhat diagrammatic view showing the retainer pronts 54*a* and 54*b* about to complete passage through the holes (in phantom) and in latched position (solid lines). It will be observed that the holes have to be larger than the prong in order to accommodate passage of the latch means 58*a* and 58*b* and in order to allow the cams 56*a* nd 56*b* to function even though the prong member 54*a* and 54*b* are resilient. The cams may be omitted in some embodiment but are desirable to positively urge the latching. In FIG. 6 the recessed shoulder 66*a* and 66*b*, which cooperate with the latch portions 58*a* and 58*b* of the prong, can be seen. It will be understood that the retainer 50 need not have a conforming part 52. However, while simple pins or screws would hold the switch in position, the retainer provides a simple, easily inserted and easily removed device which may be left in place even when not in use to hold the switch. The latch means are preferably not straight shoulders but curved so as to allow camming away from the retaining shoulders as force is applied to member 52 to withdraw the retainer. The resilience of the retainer 50 will allow necessary flexing and materials for the prongs at least should be selected with the need for flexing in mind.

Figure 3:
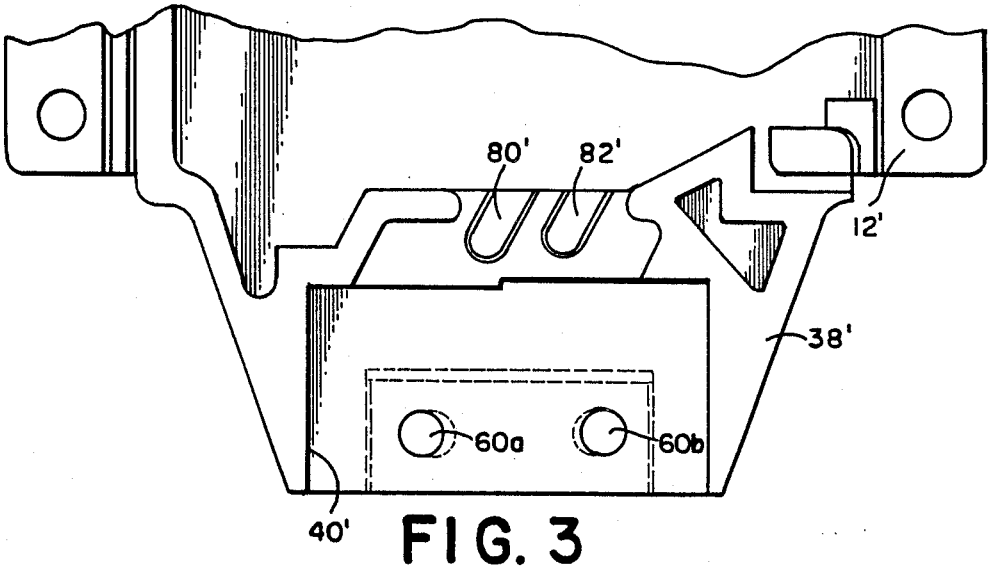
FIG. 3 is a partial plan view of the opposite shell of the switch housing from that shown in FIG. 1.

The auxiliary switch actuator member 46 is seen in greater detail in FIGS. 4*a* and 4*b*, which illustrate a preferred shape of the compressible embodiment. The actuator member 46 seen in these Figs. is preferably made of a highly resilient, rubber-like material such as Santoprene 251–92 which may be described as thermoplastic rubber. The actuator may take various forms but the form shown is preferred. In this form it consists of a sole 68, a deformable bumper 70, an interconnecting web 72 and a reinforcing longitudinal rib 74 at right angles to web 72 and effectively extending through it. Extending from both sides of the reinforcing web 74 and along the top of the base 68 are guide pin members 76, 76', 78, 78'. The bumper 70 may assume various shapes. Its sole support to the rest of the structure is the connecting web 72 and the gaps between the bumper 70 and the rib 74 may be calculated to accomplish various functions. On the end of the bumper which is primarily in contact with the actuator portion 24*a* of the contact arm 24, the structure is intended to flex, and adequate space is allowed for it to flex very substantially, effectively compressing the actuator before contacting the rib 74. On the opposite end, however, the gap between the bumper and rib 74 may be small since the movement is designed to be away from the spacing and by keeping the space small when pressure is released, the deformable actuator may rebound into a part of the rib 74 which will tend to damp its movement. The pins 76 and 78 ride in grooves 80 and 82 in the opening of right shell 12 toward the recess 40. As seen in FIG. 3, similar grooves 80', 82' in the left shell 12' engage pins 76', 78'. The pins are engaged in the respective grooves which guide them to the left as viewed in FIGS. 1 and 2. Thus as seen in FIG. 4*b*, as pressure is applied by actuator member 24*a* to bumper 70, the actuator as a whole is pushed toward the switch 42. The pins 76, 76' and 78, 78' guided by the slot 80, 80' and 82, 82' simultaneously guide the actuator as a whole to the left. Being composed of a resilient material, the bumper also deflects when the whole actuator deflects and compresses to some extent. Thus instead of moving directly into the plunger, part of the movement is diverted laterally and part of it is absorbed as compression in the actuator member which allows the switch to be adequately depressed through plunger 44 without being damaged. It will be clear to those skilled in the art that other forms of actuator could be provided, provided it is suitably confined by the housing structure or otherwise guided and retained from one position to another.

The embodiment of FIGS. 7 through lO*b* applies to another type of breaker shown in U.S. Pat. No. 4,618,745, for example. In this embodiment, corresponding parts are given corresponding numbers of those of the embodiment of FIGS. 1–6 with prefix 1 in the hundreds digit. In FIG. 7 the breaker contacts 126 and 132 are open. In FIGS. 7 and 8 the actuator 90 is no longer the compressible device 46 of FIGS. 1 to 6. Instead it is a rigid slide member 90 depicted in FIGS. 9, 10*a* and 10*b*, extending from within the switch receptacle through a hole in the housing to bear against an outside wall of housing 112. Providing a broad flat surface slide portion 92 may serve both as switch actuator guided slide and as a breaker condition indicator even when an auxiliary switch is not used. Slide member 92 passes through a confining slot 143 in the sidewall of receptacle 138 and slides along edge 112, 112'. When extended as in FIG. 7, the slide 92 covers a contrasting colored patch 145, which may be red, for example, and indicate that the breaker contacts are open. When in the position of FIG. 7, the red patch 145 is not seen but when the slide is in the position of FIG. 8, with the breaker contacts closed, the red patch 145 is clearly visible. A service man from the rear of the breaker would know from the visible red patch that the switch contacts were closed. The outer surface of the end of the slide may be a different color, such as green, to indicate breaker contacts open. Within switch receptacle 138 is a transition member 94 connected to slide 92. Member 94 which provides a stop 95 against a wall 141 of the receptacle 138, limiting movement of the slide 90. Extending through a narrow confining slot between the housing shells and the switch retainer cavity is a narrow L-shaped connector 96. The slot is made confining to help guide the structure laterally. Once within the casing, this narrow transition member flattens parallel to the inside of casing wall 112 and broadens into a slide structure 98 following the edge wall. Attached to either edge of the side structure 98 are a pair of similar hook members 100*a* and 100*b* whose curved ends 102*a* and 102*b* are designed to engage wings 128 above the movable contact 126 as the contact arm 124 moves the contact into the closed contact position of FIG. 8 and then pull the slide 90 along with it (to the right in FIGS. 7 and 8). This action moves the slide 92 away from patch 145 indicating the contacts are closed.

When the contacts open, the switch contact itself pushes the slide as seen in FIG. 7 contacting the bridging member 99 between the arms 100*a* and 100*b* before it moves up to the higher dashed line position. The contacts are now open and the red patch 145 is covered.

While the above-described embodiments constitute currently preferred embodiments of the invention, variation on structure, shape and configuration will occur to those skilled in the art. All such modifications and variations within the scope of the claims are intended to be within the scope and spirit of the present invention.

I claim:

1. A circuit breaker structure comprising:

a housing of generally rectangular form having broad enclosing faces and at least four narrow edge walls;

a circuit breaker mechanism including switch contacts within the housing;

an actuator handle extending through an access opening through one of the edge walls of the housing;

switch terminals at an opposed edge wall of the housing for connecting the breaker mechanism switch contacts of the circuit to an electrical circuit;

an auxiliary switch receptacle connected to the housing along the edge wall adjacent the switch terminals and forming an extension for independently receiving said auxiliary switch into the receptacle and supporting the entire auxiliary switch so that the auxiliary switch terminals are left accessible for electrical connection, said edge wall having an opening allowing communication between the breaker mechanism and an actuating means of the auxiliary switch;

means separable from the housing for retaining and locking the auxiliary switch to the housing in the receptacle; and an actuator member extending through the opening in the edge wall with the auxiliary switch receptacle between an actuating member for the auxiliary switch and a portion of the circuit breaker mechanism moving in response to breaker mechanism switch contacts opening and closing and retained in place laterally by a portion of the edge wall adjacent the opening.

2. The circuit breaker structure of claim 1 in which the housing is molded of resinous material and the auxiliary switch receptacle is molded integrally with the housing.

3. The circuit breaker structure of claim 2 in which the housing is molded in two half shells and cooperating parts of the auxiliary switch receptacle are molded with the respective half shell.

4. The circuit breaker structure of claim 2 in which the auxiliary switch receptacle is formed to snugly receive the entire switch with the switch terminals protruding out of the receptacle when a switch is in place.

5. The circuit breaker structure of claim 4 in which the switch is retained in the receptacle by at least one pin extending through aligned holes in the switch and receptacle walls each side of the switch.

6. The circuit breaker structure of claim 3 in which the actuator member is a resilient member having at least two guide pins on each side which engage parallel channel track means in each shell of the housing at the opening into the switch receptacle.

7. The circuit breaker structure of claim 3 in which the actuator member is a discrete member separate from but contacted and moved by the breaker mechanism, which actuator member is confined to a limited path and must compress to accommodate greater motion in the breaker mechanism than needed to actuate the switch actuating means.

8. A circuit breaker structure comprising:

a molded resinous housing of generally rectangular form having broad enclosing faces and at least four narrow edge walls;

an actuator handle extending through an access opening through one of the edge walls of the housing;

switch terminals in an opposed edge wall of the housing for connecting the breaker to an electrical circuit;

an auxiliary switch receptacle molded integrally with and connected to the housing along the edge wall adjacent the switch terminals and forming an extension for receiving and supporting an auxiliary switch so that the auxiliary switch terminals are left accessible for electrical connection, said edge wall having an opening allowing communication between the breaker mechanism and an actuating means of the auxiliary switch;

means separable from the housing for retaining and locking the auxiliary switch in the receptacle including at least two generally parallel prong members joined together by a connection member at one end in a U-shaped structure and which pass through at least two sets of aligned holes in the housing and switch; and an actuator member extending through the opening in the edge wall within the auxiliary switch receptacle between an actuating member for the auxiliary switch and a portion of the breaker mechanism moving in response to the breaker mechanism switch contacts opening and closing and retained in place laterally by a portion of the edge wall adjacent the opening.

9. The circuit breaker structure of claim 8 in which two generally parallel members comprise the retainer means, the generally parallel prong members being resilient and biased in opposite directions with latching means protruding laterally at the free ends so designed that the resilient prong members are deflected by the latching means as they are inserted through the aligned holes and their latching means resiliently snap beneath the retainer wall as they exit the aligned holes to hold the switch in place relative to the retainer and breaker mechanism.

10. The circuit breaker structure of claim 9 in which the connection member of the retainer means is designed to fit into a conforming recess in one of the walls of the retainer means when the locking means engages the opposite wall.

11. The circuit breaker structure of claim 10 in which the holes within the receptacle are enlarged below the receptacle wall surface to provide latching shoulders transverse to the holes for the latching means to engage so that the latching means need not protrude beyond the wall to latch.

12. The circuit breaker structure of claim 11 in which cam means are provided on the resilient prong on the opposite edge from the latching means to urge the latching means into latching position.

13. A circuit breaker structure comprising:

a molded resinous housing of generally rectangular form having broad enclosing faces and at least four narrow edge walls;

an actuator handle extending through an access opening through one of the edge walls of the housing;

switch terminals in an opposed edge wall of the housing for connecting the breaker to an electrical circuit;

an auxiliary switch receptacle molded integrally with and connected to the housing along the edge wall adjacent the switch terminals and forming an extension for receiving and supporting an auxiliary switch so that the auxiliary switch terminals are left accessible for electrical connection, said edge wall having an opening allowing communication between the breaker mechanism and an actuating means of the auxiliary switch;

a slide actuator member extending through the opening in the edge wall within the auxiliary receptacle between an actuating member for the auxiliary switch and a portion of the breaker mechanism moving in response to the breaker mechanism switch contacts opening and closing and retained in place laterally by a portion of the edge wall adjacent the opening and having portions which slide along both the inside and the outside surface of the edge wall, a connecting portion which extends through the opening in the wall, a portions to contact and actuate the switch actuating means and portions cooperable with the breaker mechanism to be moved one way as the switch contacts are closed and the other way as they are opened whereby the actuating means is tripped and released as the movable breaker contact assumes different positions.

14. The circuit breaker structure of claim 13 in which the actuator member has an elongated generally planar base portion which bears against the actuating means and which is connected to a bumper by a narrow transverse web extending across the narrow dimension of the base reinforced by a narrow generally longitudinal reinforcing rib fixed to the base and intersecting the web and spaced from the bumper.

15. The circuit breaker structure of claim 14 in which the two guide pins on each side of the actuator member are affixed to the base and extend through the rib, across the base and beyond the base on both sides thereof, and the actuator is confined to a limited path and must compress by at least partial deflection of the bumper to accommodate greater motion in the breaker mechanism than needed to actuate the switch actuating means.

16. The circuit breaker structure of claim 13 in which the switch contact is provided with a structure having laterally extending wings each side of the movable contact support and the actuator slide is provided with hooks engageable by the wings as the contact closes to move the slide and a structure is provided between the wing to be contacted by the back of the contact support at the contact level to move the slide in the opposite direction as the contact is open.

17. The circuit breaker structure having the switch mechanism of claim 13 in which actuating means of the switch is provided with a cam engaging surface and a cam means is provided on the slide to bear against the cam engaging surface and actuate the actuating means.

18. The circuit breaker structure having the switch mechanism of claim 13 in which the slide member outside of the breaker bearing against the wall is guided through a slot closely embracing the slide in the wall of the switch receptacle which aids in keeping the slide in position.

19. The circuit breaker structure having the switch mechanism of claim 18 in which the slide is extended so that it is beyond the wall of the receptacle when the switch contacts are open and withdrawn at least close to said wall when the contacts are closed whereby an area is covered by the slide and may be colored in some contrasting color to indicate that the breaker contacts are closed when the slide is moved by their closing.

* * * * *

UNITED STATES PATENT AND TRADEMARK OFFICE

CERTIFICATE OF CORRECTION

PATENT NO. : 4,926,148

DATED : May 15, 1990

INVENTOR(S) : Paul S. Cambreleng

It is certified that error appears in the above-identified patent and that said Letters Patent is hereby corrected as shown below:

Claim 13, Column 8, line 4, after "auxiliary" insert --switch--.

Signed and Sealed this

Seventh Day of January, 1992

*Attest:*

HARRY F. MANBECK, JR.

*Attesting Officer*

*Commissioner of Patents and Trademarks*